US007346965B2

(12) United States Patent
Hsiao

(10) Patent No.: US 7,346,965 B2
(45) Date of Patent: Mar. 25, 2008

(54) SIDE RELEASE BUCKLE

(75) Inventor: Hsiung-Ming Hsiao, Taoyuan Hsien (TW)

(73) Assignee: Nifco Taiwan Corporation, Taipei (TW)

( * ) Notice: Subject to any disclaimer, the term of this patent is extended or adjusted under 35 U.S.C. 154(b) by 0 days.

(21) Appl. No.: 11/651,006

(22) Filed: Jan. 9, 2007

(65) Prior Publication Data

US 2007/0186394 A1 Aug. 16, 2007

(30) Foreign Application Priority Data

Feb. 10, 2006 (TW) ..... 95202393 U

(51) Int. Cl.
*A44B 11/25* (2006.01)

(52) U.S. Cl. ..... 24/625

(58) Field of Classification Search ..... 24/614–616, 24/625

See application file for complete search history.

(56) References Cited

U.S. PATENT DOCUMENTS 7,096,545 B2 * 8/2006 Uehara et al. ..... 24/614
2006/0090310 A1 * 5/2006 Uehara et al. ..... 24/614

* cited by examiner

*Primary Examiner*—James R. Brittain
(74) *Attorney, Agent, or Firm*—Birch, Stewart, Kolasch & Birch, LLP

(57) ABSTRACT

A side release buckle includes a female buckle member, which has a front opening, two sloping sidewalls, two side holes respectively cut through the sloping sidewalls, and two retaining blocks respectively extended from the sloping sidewalls inside the female buckle member, and a male buckle member, which has two spring arms respectively insertable into the side holes of the female buckle member and a retaining groove on a free end of each spring arm, a springy brace connected between the two spring arms for forcing the retaining grooves into engagement with the retaining blocks after insertion of the spring arms into the side holes of the female buckle member, and a guide portion insertable into the front opening of the female buckle member to guide movement of the spring arms smoothly in the female buckle member.

6 Claims, 6 Drawing Sheets

SIDE RELEASE BUCKLE

BACKGROUND OF THE INVENTION

1. Field of the Invention

The present invention relates to buckles and more particularly, to a side release buckle, which prevents breaking of the parts during installation and unintentional release after installation.

2. Description of the Related Art

Conventional buckles that are formed of a male buckle member and a female buckle member are commonly used in backpacks, travel bags, shoulder bags, etc., to join two parts together. FIGS. 8 and 9 show a buckle of this kind. As illustrated, the buckle is comprised of a male buckle member A1 and a female buckle member A2. The male buckle member A1 has a center guide rod A12 forwardly extending from the front side, and two spring arms A11 forwardly extending from the front side and equally spaced from the center rod A12 at two sides. The two spring arms A11 each have a front end terminating in a retaining block A13 that defines a barbed engagement portion A14. The female buckle member A2 has a front open side A21, a longitudinal track A22 disposed on the inside and extending to the front open side A21 on the middle, and two side holes A23 respectively cut through the two opposite lateral sidewalls thereof. The side holes A23 each define a front engagement edge A231. When in use, the center guide rod A12 and two spring arms A11 of the male buckle member A1 are inserted into the front open side A21 of the female buckle member A2 to force the center guide rod A12 into the longitudinal track A22, and at the same time the two spring arms A11 are squeezed in direction toward the center guide rod A12 by the two opposite lateral sidewalls of the female buckle member A2. After insertion of the center guide rod A12 into the longitudinal track A22, and the spring power of the spring arms A11 of the male buckle member A1 forces the retaining blocks A13 sideways, thereby causing engagement of the barbed engagement portions A14 of the retaining blocks A13 with the respective front engagement edges A231.

The aforesaid buckle is functional, however it still has drawbacks as follows:

1. After locking, the retaining blocks A13 of the male buckle member A1 are respectively kept engaged in the side holes A23 of the female buckle member A2. However, the protruding retaining blocks A13 may be forced away from the respective side holes A23 accidentally, causing unintentional release of the buckle.
2. When fastening the male buckle member A1 to the female buckle member A2, the center guide rod A12 must be accurately aimed at the longitudinal track A22 to ensure accurate positioning. If the center guide rod A12 is not accurately aimed at the longitudinal track A22 when fastening the male buckle member A1 to the female buckle member A2, the spring arms A11 and the center guide rod A12 may be deformed or broken unintentionally.
3. It is complicated to process the barbed engagement portion A14 on the retaining block A13 of each spring arm A11. Further, processing the side holes A23 on the female buckle member A2 wastes much the material for the female buckle member A2.

Therefore, it is desirable to provide a buckle that eliminates the aforesaid drawbacks.

SUMMARY OF THE INVENTION

The present invention has been accomplished under the circumstances in view. It is one object of the present invention to provide a side release buckle, which allows easy release in a safety manner without causing damage to the parts. It is another object of the present invention to provide a side release buckle, which prevents unintentional release. To achieve these and other objects of the present invention, the side release buckle comprises a female buckle member, and a male buckle member releasably connectable to the female buckle member. The female buckle member has a front opening on a front side, two sloping sidewalls symmetrically disposed at two opposite lateral sides, two side holes respectively cut through the sloping sidewalls, and two male retaining members respectively formed on the sloping sidewalls. The male buckle member has two spring arms respectively insertable into the two side holes of the female buckle member, each spring arms having a retaining member formed on a free end for engagement with the retaining members of the female buckle member respectively after insertion of the spring arms into the two side holes of the female buckle member, and a springy brace connected between the two spring arms. Because the two sloping sidewalls of the female buckle member protects the engagement between the retaining members of the female buckle member and the retaining members of the male buckle member, the invention prevents unintentional release of the side release buckle. Further, the male buckle member has a guide portion insertable into the front opening of the female buckle member to guide movement of the spring arms into engagement with the female buckle member smoothly and positively, preventing breaking of the spring arms accidentally during installation.

DETAILED DESCRIPTION OF THE PREFERRED EMBODIMENT

Figure 1:
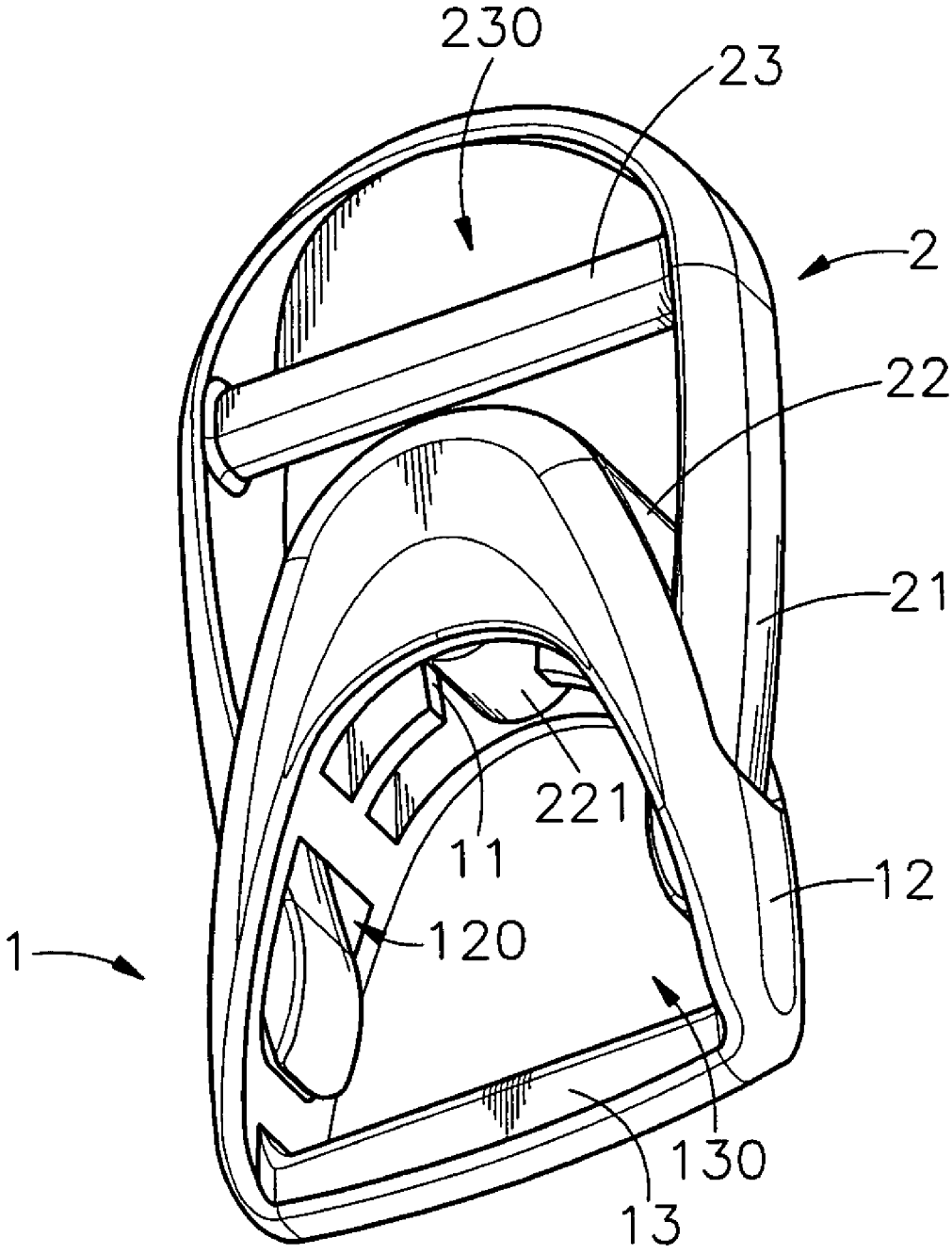
FIG. 1 is an elevational assembly view of a side release buckle according to a first embodiment of the present invention.
Figure 2:
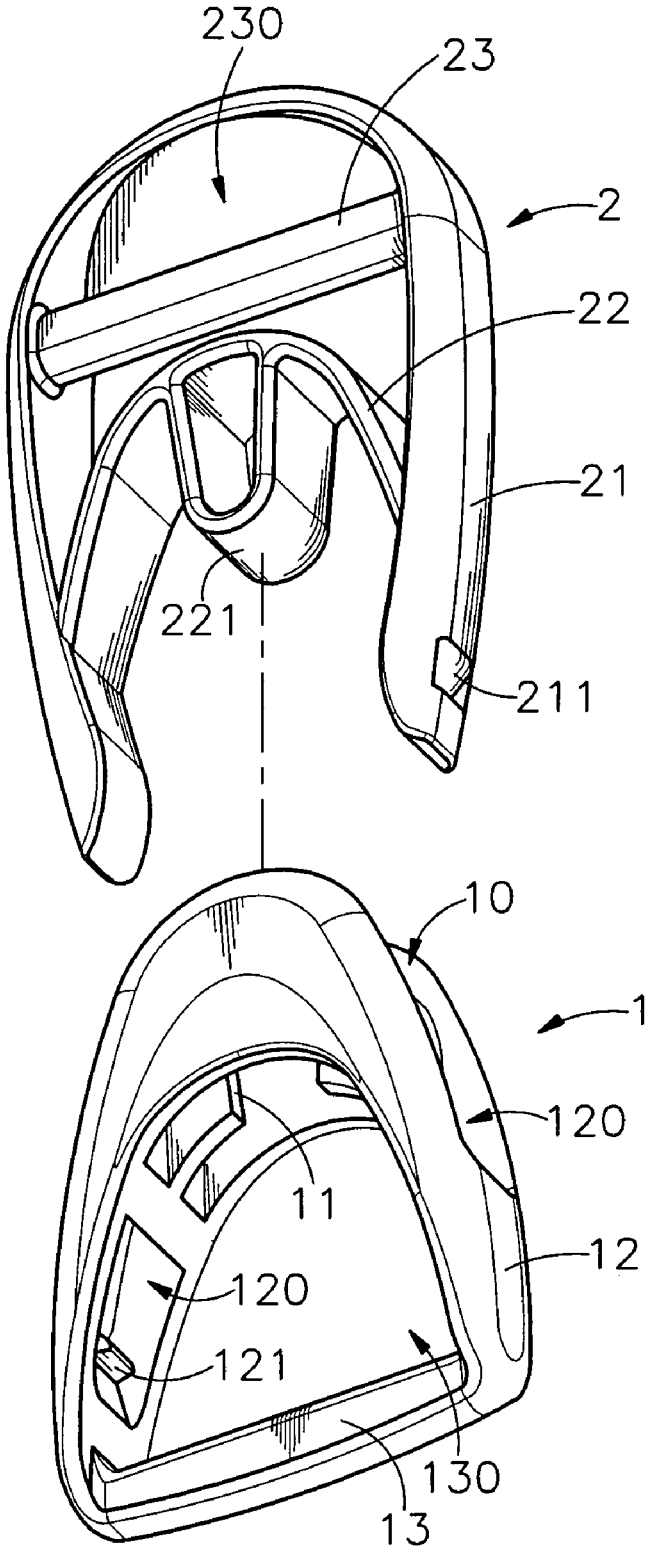
FIG. 2 is an exploded view of the side release buckle shown in FIG. 1.

Referring to FIGS. 1 and 2, a side release buckle in accordance with a first embodiment of the present invention is shown comprising a female buckle member 1 and a male buckle member 2.

The female buckle member 1 has two forwardly extending guide rails 11, a front opening 10 defined between the two guide rails 11, two sloping sidewalls 12 symmetrically disposed at two opposite lateral sides, two side holes 120 respectively cut through the sloping sidewalls 12, two retaining blocks 121 respectively protruded from the inner surfaces of the sloping sidewalls 12 at the rear ends of the side holes 120, and a transversely extending rear mounting portion 13, which defines with the two sloping sidewalls 12 an insertion hole 130 for the insertion of a strap (not shown). Further, the distance between the two sloping sidewalls 12 gradually increases in direction from the front side of the female buckle member 1 toward the rear side (i.e., in direction from the side holes 120 toward the rear mounting portion 13).

The male buckle member 2 has two spring arms 21, two retaining grooves 211 respectively formed on the free ends of the spring arms 21 at an outer side, a smoothly springy brace 22 connected between the two spring arms 21, a guide portion 221 forwardly extending from the springy brace 22 corresponding to the front opening 10 of the female buckle member 1, a mounting portion 23 joining the spring arms 21 and defining therein an insertion hole 230 for the insertion of a strap (not shown).

When fastening the side release buckle, the two spring arms 21 are respectively inserted through the side holes 120 of the female buckle member 1, and at the same time the guide portion 221 is inserted into the front opening 10 of the female buckle member 1 between the two guide rails 11 to guide movement of the two spring arms 21 along the inner surfaces of the sloping sidewalls 12 of the female buckle member 1 smoothly, thereby forcing the retaining grooves 211 of the spring arms 21 into positive engagement with the respective retaining blocks 121 of the female buckle member 1. Because the sloping sidewalls 12 of the female buckle member 1 protect the engagement between the retaining grooves 211 and the retaining blocks 121, the invention prevents unintentional release of the side release buckle.

Figure 3C:
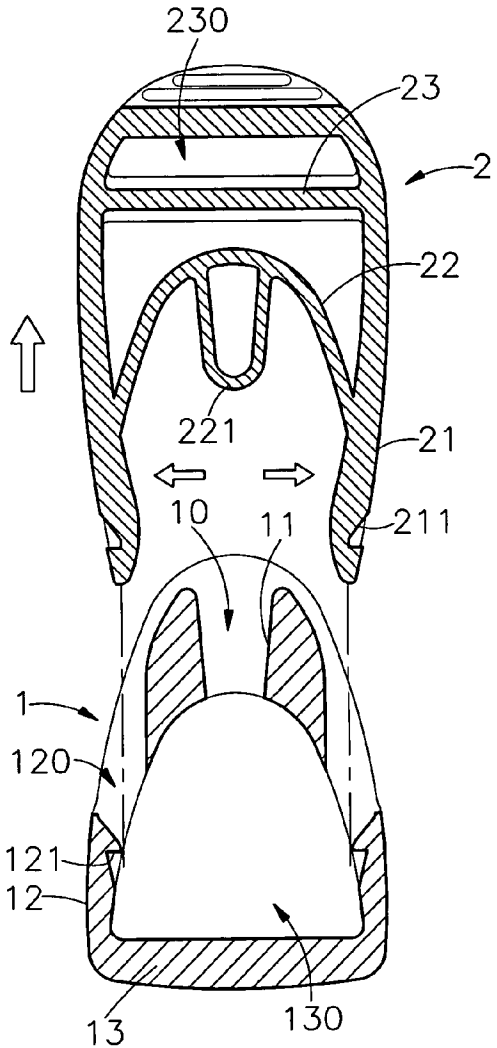
FIG. 3C is a schematic sectional view showing the release operation of the side release buckle in accordance with the first embodiment of the present invention (III).
Figure 3B:
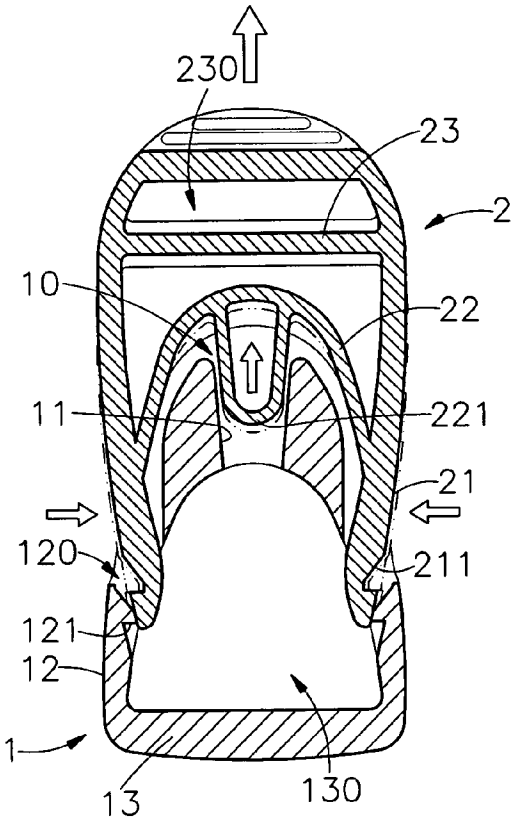
FIG. 3B is a schematic sectional view showing the release operation of the side release buckle in accordance with the first embodiment of the present invention (II).
Figure 3A:
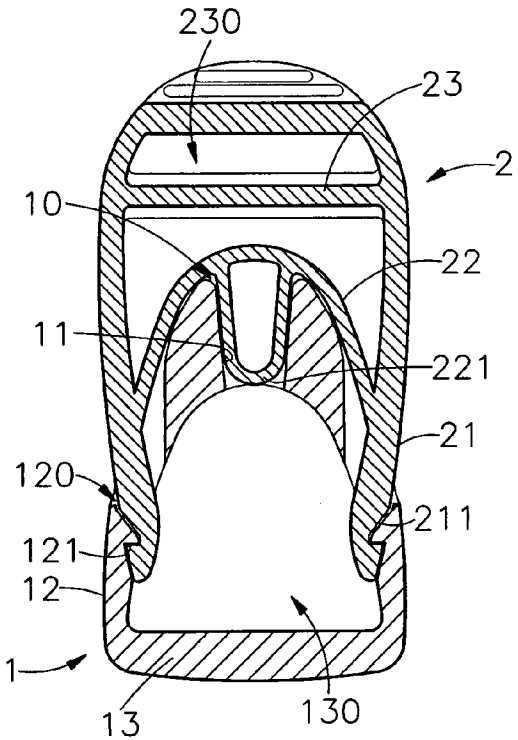
FIG. 3A is a schematic sectional view showing the release operation of the side release buckle in accordance with the first embodiment of the present invention (I).

When releasing the side release buckle, as shown in FIGS. 3A, 3B and 3C, squeeze the two spring arms 21 of the male buckle member 2 with the fingers to disengage the retaining grooves 211 of the spring arms 21 from the respective retaining blocks 121 of the female buckle member 1 (see FIG. 3B), and then pull the male buckle member 2 to move the spring arms 21 out of the side holes 120 of the female buckle member 1 (see FIG. 3C).

Figure 4:
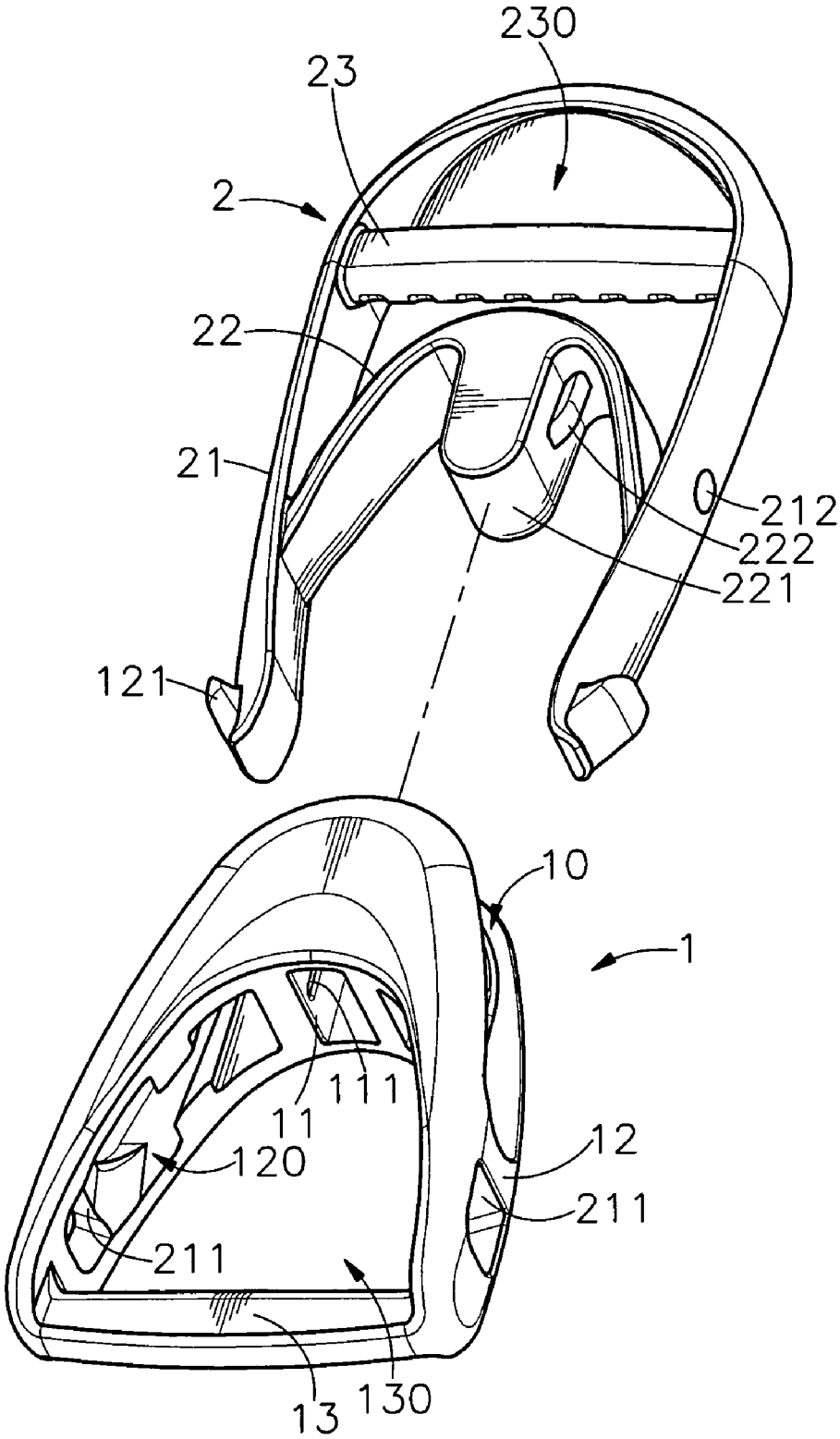
FIG. 4 is an exploded view of a side release buckle in accordance with a second embodiment of the present invention.
Figure 5:
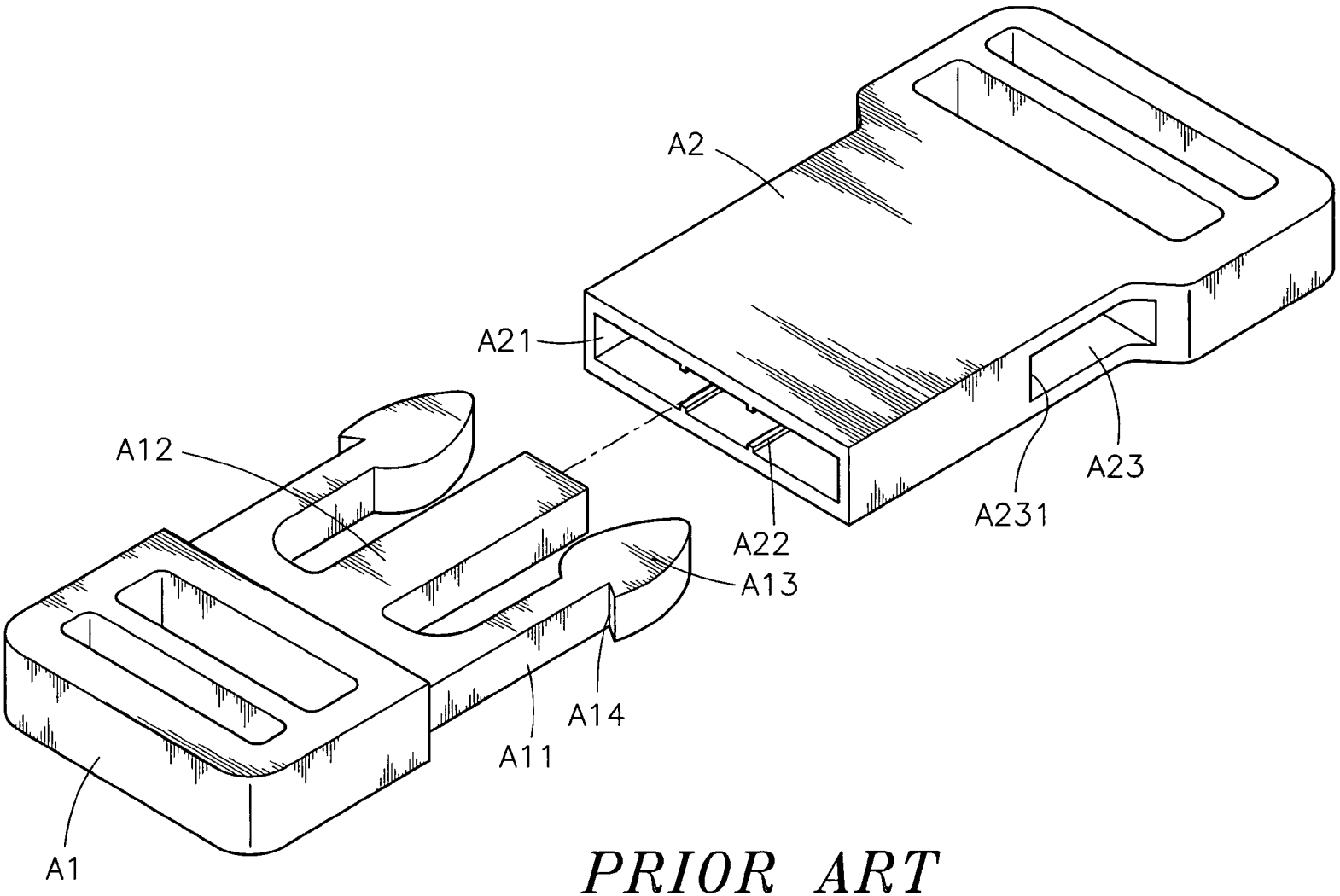
PRIOR ART FIG. 5
FIG. 5 is an exploded view of a buckle according to the prior art.
Figure 6:
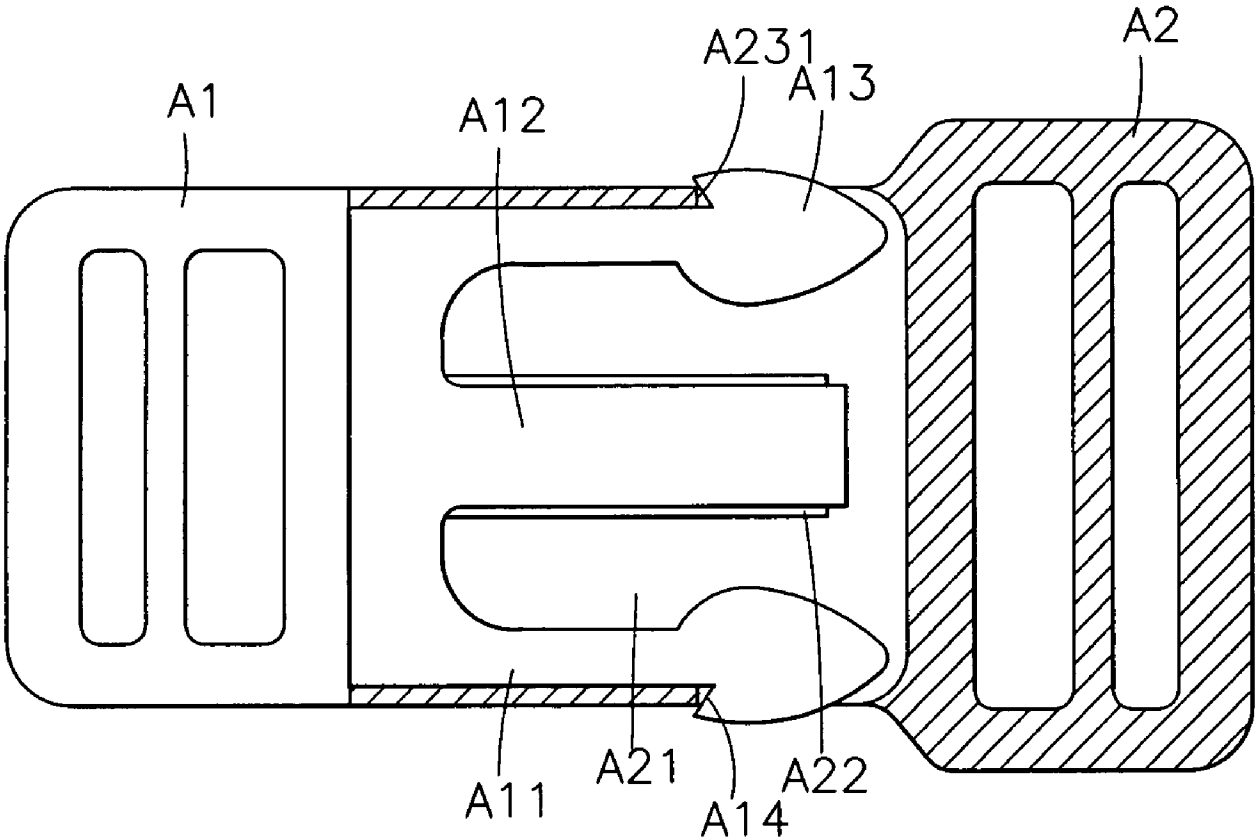
PRIOR ART FIG. 6
FIG. 6 is a sectional view of the buckle according to the prior art design, showing the male buckle member and the female buckle member locked.

FIG. 4 shows a side release buckle in accordance with a second embodiment of the present invention. According to this embodiment, the two retaining blocks 121 are respectively provided at the free ends of the spring arms 21 of the male buckle member 2, and the two retaining grooves 221 are respectively formed on the two sloping sidewalls 12 of the female buckle member 1. Furthermore, the two rails 11 of the female buckle member 1 each have a longitudinal sliding groove 111 at an inner side. The male buckle member 2 has two sliding blocks 222 respectively protruded from two opposite lateral sides of the guide portion 221 and respectively slidably insertable into the longitudinal sliding grooves 111 of the female buckle member 1, and two press portions 212 respectively provided at the spring arms 21 at an outer side for pressing by the user's fingers to squeeze the spring arms 21 toward each other when releasing the male buckle member 2 from the female buckle member 1.

As indicated above, the invention provides an improved design of side release buckle, which has the following features:

1. When the male buckle member 2 and the female buckle member 1 of the side release buckle according to the first embodiment of the present invention are fastened up, the sloping sidewalls 12 of the female buckle member 1 protect the engagement between retaining grooves 211 and the retaining blocks 121, preventing unintentional release of the side release buckle.
2. When inserting the spring arms 21 of the male buckle member 2 into the side holes 120 of the female buckle member 1, the guide portion 221 of the male buckle member 2 is inserted into the front opening 10 between the two guide rails 11 of the female buckle member 1, and the guide rails 11 guide the male buckle member 2 smoothly into positive engagement with the retaining blocks 121 of the female buckle member 1, preventing deformation of damage of the spring arms 21.
3. The side holes 120 of the female buckle member 1 are simple through holes that formed directly upon injection molding of the female buckle member 1 without a further processing process. Therefore, the fabrication of the side release buckle does not waste the material.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A side release buckle comprising a female buckle member and a male buckle member releasably connectable to said female buckle member, wherein:

said female buckle member has a front side and a rear side, a front opening on said front side, two sloping sidewalls symmetrically disposed at two opposite lateral sides thereof, two side holes respectively cut through said sloping sidewalls, and two retaining members respectively formed on said sloping sidewalls;

said male buckle member has two spring arms respectively insertable into said two side holes of said female buckle member, said spring arms each having a free end and a retaining member formed on said free end for engagement with the retaining members of said female buckle member respectively after insertion of said spring arms into the two side holes of said female buckle member, and a springy brace connected between said two spring arms, wherein the distance between said two sloping sidewalls of said female buckle member gradually increases in direction from the front side of said female buckle member toward the rear side thereof.

2. The side release buckle as claimed in claim 1, wherein said male buckle member has a guide portion forwardly extending from said springy brace and insertable into the front opening of said female buckle member; said female buckle member has two guide rails disposed at two sides of said front opening for guiding movement of said guide portion of said male buckle member in said front opening of said female buckle member.

3. The side release buckle as claimed in claim 2, wherein said guide rails of said female buckle member each have a longitudinal sliding groove at an inner side thereof; said male buckle member has two sliding blocks respective protruded from two opposite lateral sides of said guide portion and respectively slidably insertable into the longitudinal sliding grooves of said guide rails of said female buckle member.

4. The side release buckle as claimed in claim 1, wherein said spring arms each have a press portion at an outer side thereof for pressing by a user to squeeze said spring arms toward each other.

5. The side release buckle as claimed in claim 1, said male buckle member has a mounting portion joining said spring arms and defining therein an insertion hole for the insertion of a strap.

6. The side release buckle as claimed in claim 1, wherein said female buckle member has a mounting portion at the rear side thereof and defining with said sloping sidewalls an insertion hole for the insertion of a strap.

* * * * *